US007438007B1

(12) United States Patent
Hall

(10) Patent No.: US 7,438,007 B1
(45) Date of Patent: Oct. 21, 2008

(54) LEVEL CUT LOOP LOOPER AND CLIP ASSEMBLY

(75) Inventor: Wilton Hall, Ringgold, GA (US)

(73) Assignee: Card-Monroe Corp., Chattanooga, TN (US)

( * ) Notice: Subject to any disclaimer, the term of this patent is extended or adjusted under 35 U.S.C. 154(b) by 0 days.

(21) Appl. No.: 11/736,215

(22) Filed: Apr. 17, 2007

Related U.S. Application Data

(60) Provisional application No. 60/895,599, filed on Mar. 19, 2007.

(51) Int. Cl.
*D05C 15/22* (2006.01)
*D05C 15/00* (2006.01)

(52) U.S. Cl. ..... 112/80.51

(58) Field of Classification Search ..... 112/80.5–80.6
See application file for complete search history.

(56) References Cited

U.S. PATENT DOCUMENTS

| | | | | |
|---|---|---|---|---|
| 3,202,379 | A | 8/1965 | Dedmon et al. | |
| 3,919,953 | A | 11/1975 | Card et al. | |
| D253,473 | S * | 11/1979 | Jolley | D15/78 |
| 4,285,288 | A * | 8/1981 | Inman et al. | 112/80.56 |
| 4,303,024 | A | 12/1981 | Bardsley | |
| 4,366,761 | A | 1/1983 | Card | |
| 4,419,944 | A | 12/1983 | Passons et al. | |
| 4,440,102 | A | 4/1984 | Card et al. | |
| 4,448,137 | A | 5/1984 | Curtis et al. | |
| 4,522,132 | A | 6/1985 | Slattery | |
| 4,602,576 | A | 7/1986 | Cox | |
| 4,619,212 | A | 10/1986 | Card et al. | |
| 4,630,558 | A | 12/1986 | Card et al. | |
| 4,815,403 | A | 3/1989 | Card et al. | |
| 4,836,118 | A | 6/1989 | Card et al. | |
| 4,903,625 | A | 2/1990 | Card et al. | |
| 5,058,518 | A | 10/1991 | Card et al. | |
| 5,224,434 | A | 7/1993 | Card et al. | |
| 5,295,450 | A | 3/1994 | Neely | |
| 5,345,885 | A | 9/1994 | Yoshino | |
| 5,400,727 | A | 3/1995 | Neely | |
| 5,509,364 | A | 4/1996 | Bardsley | |
| 5,513,586 | A | 5/1996 | Neely | |
| 5,896,821 | A | 4/1999 | Neely et al. | |
| 7,007,617 | B2 * | 3/2006 | Johnston | 112/80.51 |
| 7,165,500 | B1 | 1/2007 | Yoshino | |
| 7,237,497 | B2 * | 7/2007 | Johnston | 112/80.6 |
| 7,284,492 | B2 * | 10/2007 | Johnston | 112/80.6 |

* cited by examiner

*Primary Examiner*—Ismael Izaguirre
(74) *Attorney, Agent, or Firm*—Womble Carlyle Sandridge & Rice, PLLC

(57) ABSTRACT

A level cut loop looper or hook and clip for a tufting machine includes a looper body having a channel in which a clip is received. The clip is moved between extended and retracted positions by an actuator as the level cut loop looper or hook is reciprocated into engagement with a needle of the tufting machine, so as to selectively form cut and loop pile tufts in a backing material.

9 Claims, 3 Drawing Sheets

LEVEL CUT LOOP LOOPER AND CLIP ASSEMBLY

CROSS REFERENCE TO RELATED APPLICATIONS

The present patent application is a formalization of previously filed, co-pending U.S. provisional patent application Ser. No. 60/895,599, filed Mar. 19, 2007, by the inventor named in the present application. This patent application claims the benefit of the filing date of the cited provisional patent application according to the statutes and rules governing provisional patent applications, particularly USC § 119 (e)(1) and 37 CFR § 1.78(a)(4) and (a)(5). The specification and drawings of the provisional patent application are specifically incorporated herein by reference.

FIELD OF THE INVENTION

The present invention generally relates to tufting carpets and in particular to a new design level cut looper and clip for forming loop and cut pile tufts of yarns in a backing material to form patterned carpets.

BACKGROUND OF THE INVENTION

In the field of tufting carpets, it has been known to tuft carpets having spaced rows of loop pile and cut pile tufts, including the formation of loop pile and cut pile tufts in the same longitudinal tuft rows of the carpet. For example, U.S. Pat. No. 3,919,953 discloses an apparatus and method for tufting spaced rows of loop pile tufts and cut pile tufts in a backing material using a multi-needle tufting machine having spaced transverse rows of needles that cooperate with a series of loop pile loopers or cut pile hooks mounted on the upstream and down stream sides, respectively, of the tufting machine.

Additionally, patents such as U.S. Pat. Nos. 6,155,187 and 7,007,617 disclose level cut loop hook or looper assemblies for tufting machines for selectively forming cut pile and loop pile tufts in a backing material. Such level cut loop hook assemblies generally include a cut pile hook and a slideable clip that can be moved into a position in engagement with the hooked front end of the level cut loop hook so as to block or otherwise prevent loops of yarns from being retained on the level cut loop hook and thereafter cut by an associated reciprocating cutting blade. Alternatively, other designs have been proposed in which a clip slides along or bears against the sides of a loop pile looper to facilitate capturing of the loops of yarn on the looper for cutting by the associated cutting blade.

A problem that exists with many conventional level cut looper/hook assemblies is, however, that the loops of yarn being formed about the clips and hooks when the clips are in their extended position often are not uniformly formed, especially in comparison with the cut pile tufts, which can result in a pile height differential between the cut and loop pile tufts. In addition, when the clips are in their fully extended positions, the loops of yarn carried by the needles being engaged by the hooks and clips sometimes are not picked cleanly and can be backrobbed by the return stroke of the needles. Consequently, it often is necessary to run the needles at a deeper stroke or depth so as to ensure that the needles will penetrate the backing material to a depth sufficient to be engaged and their yarns picked substantially cleanly therefrom during a tufting operation. As a result, the level cut loop tufting machines generally must be run at slower operating speeds to accommodate such greater penetration depths and to minimize other problems such as backrobbing of the yarns.

According, it can be seen that a need exists for a level cut loop hook/looper and clip assembly that addresses the foregoing and other related and unrelated problems in the art.

SUMMARY OF THE INVENTION

Briefly described, the present invention generally relates to an improved level cut loop looper or hook and clip assembly for use in forming level cut loop tufted patterns in a backing material passing through the tufting zone of a tufting machine. Each level cut loop looper assembly of the present invention generally includes a looper or hook having an elongated body including a shank portion that is received within a holder or module and a forwardly extending throat portion that terminates in a hooked forward end. The holder or module for the level cut loop looper itself is mounted to a gauge bar that is attached to a rocker shaft of similar drive mechanism for driving a plurality of level cut loop looper or hook and clip assemblies in a reciprocating motion toward and away from engagement with one or more needles of the tufting machine.

Each of the level cut loop loopers further generally includes a slot or channel formed along its shank portion. A clip generally is slideably received along this channel or slot formed in each of the loopers or hooks. Each of the clips typically is an elongated or substantially rectangularly shaped member having a substantially flat front edge and a hooked rear end. The hooked rear end of each clip extends outwardly from the rear of the channel or slot of its level cut loop looper and through a corresponding slot or channel formed in the holder or module, and engages a gate that is connected to one of a series of plurality of actuators. The actuators can include hydraulic or pneumatic cylinders that are selectively activated so as to move the clips between an extended, engaging position, or to a retracted, non-engaging position for selectively forming cut and loop pile tufts.

When the clips are in their extended, engaging positions, the flat front edges of each selected clip is adapted to engage and bear against the rear edge of the hooked front end of its associated level cut loop looper without extending past or beneath the lower edge of the hook front end. As a result, the space behind the hooked front end of the selected level cut loop looper is closed so as to prevent the formation and capture of loops of yarn along the throat portions of the level cut loop loopers. As a further result, the loops of yarn that are formed about the hooked front end of each of the level cut loop loopers are formed at a consistent length, without requiring variation of the needle stroke, and are released so as to form loop pile tufts of yarns in the backing material. As the clips are retracted, the loops of yarns are allowed to move along and be captured on the throat portions of the hooks. Thereafter, the captured loops of yarns along the throat portion of the hooks are engaged and cut by a knife or cutting blade reciprocated into engagement therewith so as to form cut pile tufts of yarn in the backing material.

Various objects, features, and advantages of the present invention will become apparent to those skilled in the art upon a review of the following detailed description when taken in conjunction with the accompanying drawings.

DETAILED DESCRIPTION OF THE INVENTION

Figure 1:
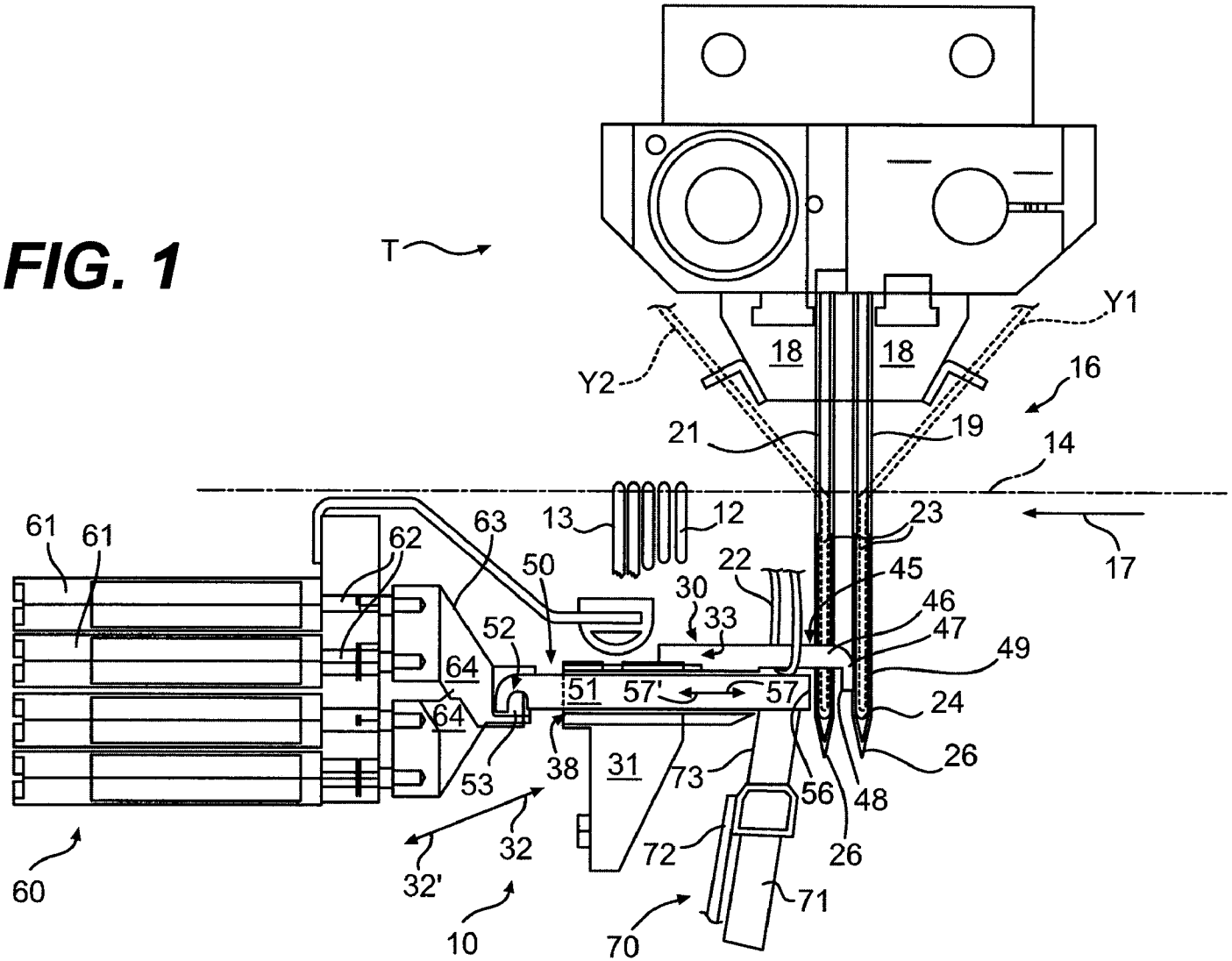
FIG. 1 is a side elevational view illustrating the level cut loop assembly of the present invention.

Referring now in greater detail to the drawings in which like numerals indicate like parts throughout the several views, the present invention generally relates to a level cut loop looper and clip assembly 10 for use in a tufting machine T for forming tufted carpets or similar tufted articles having loop pile and cut pile tufts 12 and 13 (FIG. 1) formed in a backing material 14 as the backing material is fed through a tufting zone 16 of the tufting machine T in the direction of arrow 17. As indicated in FIG. 1, the tufting machine generally will include one or more needle bars 18 that carry a series of spaced needles 19 and 21. The needles 19 and 21 carry a series of yarns Y1 and Y2 as the needles are reciprocated vertically into and out of the backing material so as to form the loop and cut pile tufts 12 and 13, respectively in the backing material.

Although FIG. 1 illustrates the use of the present invention with a pair of needle bars 18, each including a single row of needles 19 and 21 carried thereby, it will be understood by those skilled in the art that the present invention also can be utilized with carpet tufting machines that include single needle bars carrying multiple rows of spaced needles therealong. In addition, while only a single needle has been shown in each needle bar 18, it will be understood that a series of needles 19/21 will be transversely spaced across each of the needle bars, spaced at a prescribed gauge or spacing, with the number of needles thus depending on the gauge and size of the tufting machine. In addition, the needle bars 18 can be shiftable needle bars that are shifted transversely across the tufting zone 16 by a shift mechanism (not shown) such as a cam, servomotor, or other shift mechanism, such as a Smart Step™ shifter mechanism produced by Card-Monroe Corp. The needle bars further will be driven by the tufting machine in a vertically reciprocal stroke so as to move the needles between a raised, non-engaging position wherein the needles are out of the backing material or fabric 14, and a lowered, engaging position as shown in FIG. 1, in which the needles 19 and 21 penetrate the backing material 14 to a depth sufficient to be engaged, and loops of yarn 22 are picked therefrom by the level cut looper and clip assembly 10 of the present invention.

Each of the needles 19 and 21 further generally will include a channel 23 that extends at least partially along the length of each needle and terminates at a take-off or pickup area 24 adjacent the lower end or point 26 of each needle 19 and 21. The pickup or takeoff area 24 of each of the needles define the area or point at which the level cut loop looper and clip assemblies 10 of the present invention engage the needles and pick the loops of yarn 22 therefrom.

As FIG. 1 illustrates, the level cut loop looper and clip assembly 10 of the present invention generally includes a level cut loop looper or hook 30 that is mounted within a holder or support module 31. It is reciprocated toward and away from the needles 19 and 21 in the direction of arrows 32 and 32' by a drive mechanism, not shown, in a timed relationship with the stroke or reciprocating movement of the needles. As indicated in FIGS. 2-4A, the level cut loop looper or hook 30 generally includes a looper or hook body 33 typically from a material such as steel or similar metal, although other metals such as various ceramic or synthetic materials also can be used. The body 33 includes an elongated shank portion 34 that extends from a first or move the clip to a recessed, non-engaging position spaced from the rear surface 48 of the hooked end 47 of the level cut loop looper or hook 30, as indicated in FIG. 1. In such a retracted position, as the yarns Y1 and Y2 are engaged by the level cut loop loopers 30, the loops of yarn 22 picked from the needles can be pulled and captured along the throat portions 46 of the level cut loopers or hooks 30. With the clips in their fully extended position, as indicated in FIG. 3, the engagement of the front faces 56 of the clips 50 against the rear surfaces 48 of the hooked front ends 47 of their selected level cut loop loopers or hooks 30 prevents the loops of yarn 22 from being received and captured along the throat portions 46 of the level cut loop loopers or hooks. As a result, as the level cut loop loopers or hooks are retracted in the direction of arrows 32' (FIG. 1) the loops of yarn generally will be pulled off the hooked front end of the selected level cut loop loopers or hooks and remain as loop pile tufts 12 formed in the backing material 14. Those loops that remain on the throat portion will be cut to form the cut pile tufts 13.

As further illustrated in FIG. 1, the level cut loop looper clip assembly 10 of the present invention generally includes a drive mechanism or assembly 60 for driving or moving the clips 50 in the direction of arrows 57 and 57', between their extended, engaging position and retracted position. The drive assembly 60 generally includes a series of actuators 61, here illustrated as pneumatic or hydraulic cylinders, although it will be understood by those skilled in the art that other types of actuators, including drive motors, also can be used. Each of the actuators generally includes a cylinder or drive rod 62 that attaches to a gate connector 63. Each gate includes a downwardly or upwardly extending connector portion 64 that is engaged by and thus connects to the hooked first or proximal end 52 of an associated clip 50 via its engaging recess 53 as illustrated in FIG. 1. The actuators 61 of the drive mechanism or assembly 60 further generally proximal end 36 of the looper or hook body to an intermediate portion 37 along the looper or hook body. The shank further defines a channel or recessed passage 38 extending between the first end 36 and intermediate portion 37 of the looper or hook body 33. The channel 38 generally is a substantially C-shaped channel having parallel upper and lower sides 39, 41, and is open at its ends 42 and 42' formed at the first end 36 and intermediate portion 37 of the looper or hook body 33, as indicated in FIGS. 3 and 4A.

The level cut loop looper or hook 30 further includes a forwardly extending portion or bill 45 that extends forwardly toward the needles of the tufting machine from the shank portion 34 of the looper or hook body 33. The forwardly extending portion 45 further includes a throat portion 46 along which the loops of yarns 22 can be captured and held, as indicated in FIG. 1 and a hooked or downwardly turned forward, second, or distal end 47. The hooked front or distal end 47 of the level cut loop looper or hook 30 has a flat rear edge or side 48 and a flat bottom edge or surface 49. In operation of the level cut loop looper or hook, the hooked front 47 engages the pickup or takeoff point 24 of its associate needle 19 or 21 for picking up and pulling the loops of yarn 22 through therefrom.

Figure 2:
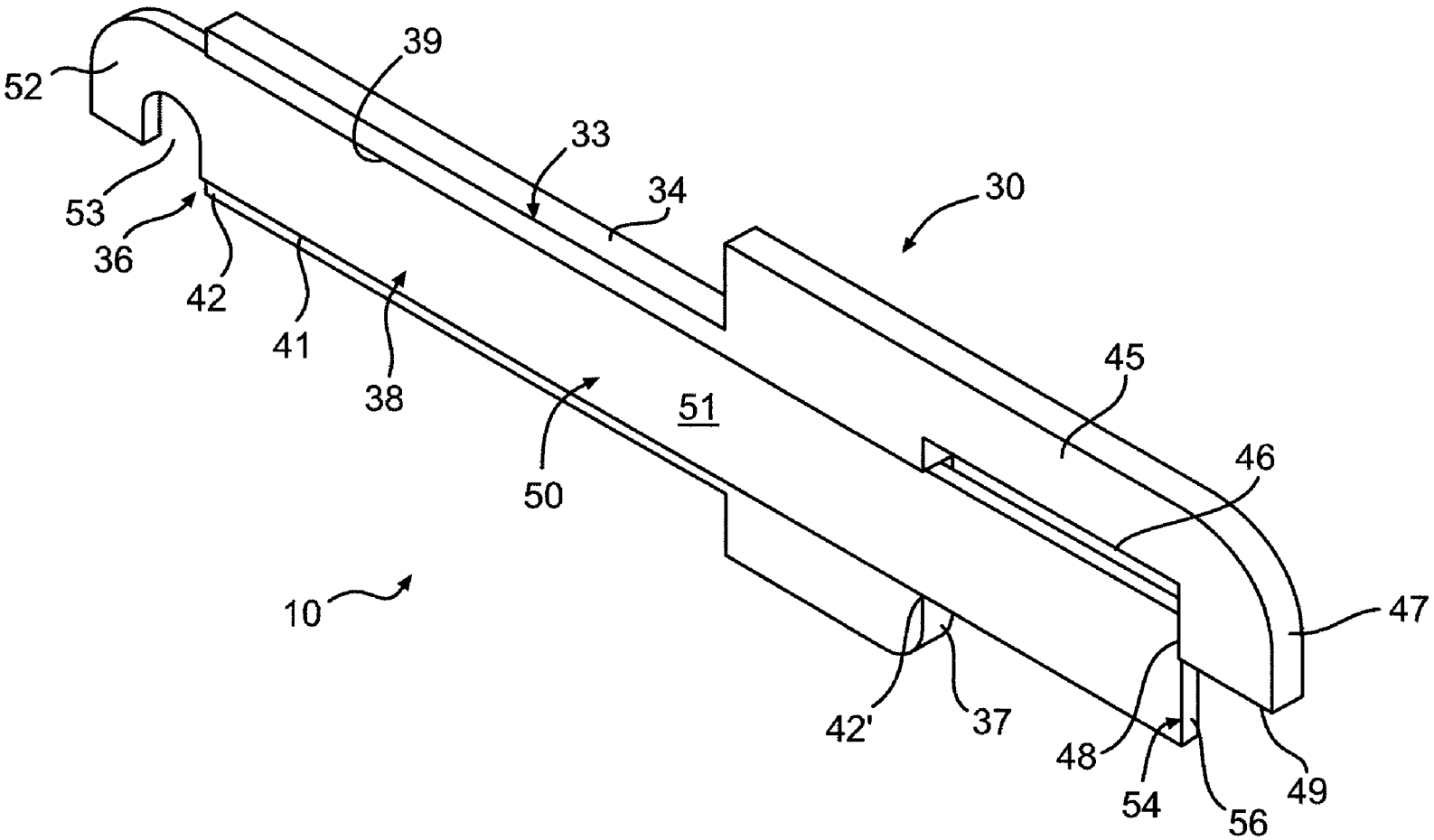
FIG. 2 is a perspective illustration of the level cut loop hook and clip of the present invention.
Figure 3:
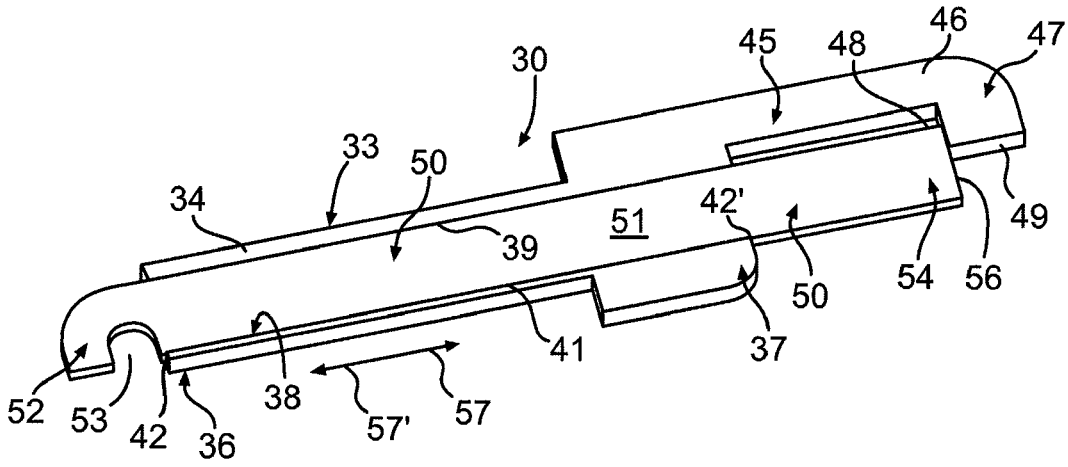
FIG. 3 is a bottom perspective view of the level cut loop hook and clip of the present invention.
Figure 4A:
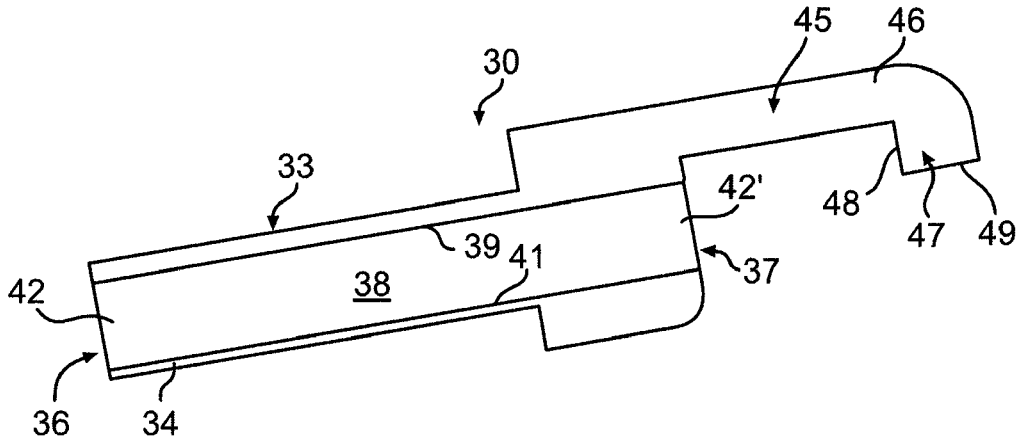
FIG. 4A is a perspective illustration of the level cut loop hook.
Figure 4B:
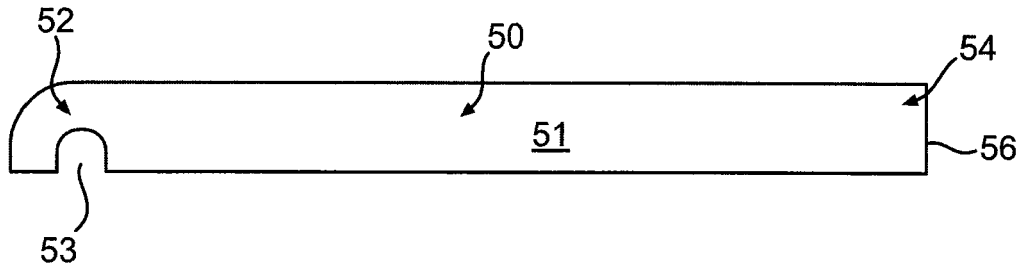
FIG. 4B is a side elevational view of the clip for the level cut loop hook of FIGS. 2 and 3.

As additionally illustrated in FIGS. 1-3 and 4B, a clip 50 is received within the channel 38 of each level cut loop looper or hook 30. Each clip 50 generally is an elongated member having a substantially rectangular shaped body 51 with a first end 52 including an engaging recess 53 formed thereat, and a second end 54 having a substantially flat, vertically extending face or surface 56. As indicated in FIGS. 2 and 3, the flat face or surface 56 of the clip 50 is adapted to engage and bear against the flat rear surface 48 of the hooked front end 47 of its associated level cut loop looper or hook 30, when the hook is in a fully extended position. The clip further can be moved or slid rearwardly in the direction of arrows 57 and 57' as needed to can be mounted in a bank or array arranged along the downstream side of the tufting zone 16 behind the level cut loop loopers and hooks.

A cutting assembly 70 further generally is provided below the level cut loop looper and clip assembly 10. As illustrated in FIG. 1, the cutting assembly 70 generally includes a series of cutting blades 71 or knives, each mounted within a holder 72 connected to a drive mechanism (not shown). Each cutting blade 71 is reciprocated toward and into engagement with the throat portion 46 of its associated level cut loop or looper 30 so that it's cutting edge 73 contacts and cuts the loops of yarn 22 that are captured along the throat portion 46 of the level cut loop looper or hook. As a result, the loops of yarn 22 are severed or cut to form the cut pile tufts 13.

In operation of the level cut loop looper and clip assembly 10 of the present invention, as the needles 19 and 21 penetrate the backing material, the level cut loop loopers or hooks 30 are reciprocated into and out of engagement with their respective needles in the direction of arrows 32 and 32' as indicated in FIG. 1. As the hooked front end 47 of each level cut loop looper or hook 30 strikes the take off portion 24 of its associated needle 19 or 21, a loop of yarn 22 is engaged and picked up along the bottom surface 49 of the hooked front end 47 of the level cut loop looper or hook. When the clips 50 of selected level cut loop loopers or hooks 30 are in their retracted position as illustrated in FIG. 1, the loops of yarn 22 caught or picked up by the hooked front ends 47 of those particular level cut loop loopers or hooks are permitted to pass over their hooked front ends and into engagement with the throat portions 46 of such level cut loop loopers or hooks so that the loops of yarn are captured therealong. Thereafter, as the cutting blades 71 of the cutting assembly are reciprocated into engagement with the throats of the level cut loopers or hooks, any loops or yarn 22 captured therealong are severed so as to form the cut pile tufts 13.

To form loop pile tufts, selected ones of the actuators 61 will be engaged so as to cause their associated clips 50 to be extended or moved in the direction of arrows 57 into their extended, engaging positions. As indicated in FIGS. 2 and 3, in their extended, engaging positions, the flat front ends 56 of the selected clips engage and bear against the flat rear surfaces or edges 48 of the hooked front ends 47 of their associated level cut loop loopers or hooks 30. In this position, the loops of yarn 22 that are picked up from the needles by the engagement of the hooked front ends 47 of the level cut loop loopers or hooks with the needles 19/21 are prevented from passing over the flat lower surfaces 49 of the hooked front portions 47 and onto the throat portions 46 of the selected level cut loopers or hooks. Thereafter, as the level cut loop loopers or hooks 30 are reciprocated rearwardly in the direction of arrows 32' (FIG. 1) the loops of yarn captured on the hooked front ends 47 of such level cut loop loopers or hooks are pulled therefrom and thus will remain uncut so as to form the loop pile tufts 12 in the backing material.

With the level cut loop looper and clip assembly design of the present invention, the clip does not extend past the rear edge of the hooked front end of the level cut loop looper or hook and thus does not add to the stroke or length of travel that the needles must be extended in order to form the loops of yarn thereabout in forming cut pile tufts. As a result, the present invention allows more uniformity in the length of loop and cut pile tufts being formed by the level cut loop looper and clip assembly of the present invention, and further enables a smoother stripping of the yarn from the hooked front ends of the level cut loop loopers or hooks without interference from the clips to avoid backrobbing or pullback of the yarns. Importantly, the present invention enables the use of consistent sized loopers or hooks and consistent operation or stroke of the needles with the depths of the yarn drive or stroke through the backing material being minimized and substantially uniform.

It will be further understood by those skilled in the art that while the foregoing has been disclosed above with respect to preferred embodiments or features, various additions, changes, and modifications can be made to the foregoing invention without departing from the spirit and scope of thereof.

What is claimed:

1. A level cut loop looper and clip assembly for a tufting machine, comprising:

a plurality of level cut loop loopers, each having a looper body comprising a rear portion, a shank portion, a throat portion extending forwardly from said shank and terminating at a forward end, and a longitudinally extending channel formed along said looper body;

wherein said forward end of each level cut loop looper comprises a hooked portion extending downwardly from said throat portion; and a plurality of clips each having a first end extending through said channel toward said rear portion of said looper body and a second end spaced from said first end and wherein said second end comprises a substantially flat front end adapted to engage against said hooked portion of an associated level cut loop looper to prevent the capture of loops of yarns alone said throat portion of said level cut loop looper; and wherein each of said clips is slidably received along a channels of its associated level cut loop looper and is moveable therealong between a retracted position and an extended position in engagement with a rear side of said hooked portion of said forward end of said level cut loop looper to enable formation of cut and loop pile tufts of yarns by said level cut loop looper.

2. The level cut loop looper and clip assembly of claim 1 and further comprising a plurality of actuators for moving said clips between their extended and retracted positions.

3. The level cut loop loopers and clip assembly of claim 2 and further comprising a series of gates attached at one end to each of said actuators and adapted to engage said first ends of said clips for moving said clips between their extended and retracted positions.

4. The level cut loop looper and clip assembly of claim 1 and wherein each of said channels of each of said level cut loop loopers comprises an open-ended recess having a configuration that substantially matches each of said clips slideably received therealong.

5. A tufting machine for forming cut and loop pile tufts of yarns in a backing material, comprising:

at least one needle bar having a series of needles spaced therealong and carrying a plurality of yarns for insertion into the backing material;

a plurality of level cut loop loopers reciprocable into engagement with said needles for picking and pulling loops of yarns therefrom, each of said level cut loop loopers having a shank portion, a throat portion projecting from said shank portion towards said needles and terminating in a hooked front end, and an elongated channel formed along said shank portion; and a plurality of clips each comprising a substantially rectangular body having a substantially flat front end adapted to engage against a rear side of said hooked portion of an associated level cut loop looper to prevent the capture of loops of yarns along said level cut loop looper;

wherein said clips are each adapted to be received and slide along one of said channels of said level cut loop loopers so as to be moveable between a retracted position and an extended position into engagement with said rear side of said hooked front end of its level cut loop looper for selectively forming the cut and loop pile tufts of yarns in the backing material.

6. The tufting machine of claim 5 and further comprising a plurality of actuators for moving said clips between their extended and retracted positions.

7. The tufting machine of claim 6 and further comprising a series of gates attached at one end to each of said actuators and adapted to engage said second ends of said clips for moving said clips between their extended and retracted positions.

8. The tufting machine of claim 5 and further comprising a plurality of cutting assemblies each including a knife reciprocated into engagement with a throat portion of one of said level cut loop loopers for cutting loops of yarns captured therealong.

9. The tufting machine of claim 5 and wherein each of said channels of each of said level cut loop loopers comprises an open-ended recess having a configuration that substantially matches each of said clips slideably received therealong.

* * * * *